United States Patent [19]

Handy

[11] Patent Number: 4,915,336

[45] Date of Patent: Apr. 10, 1990

[54] ADAPTOR AND SUPPORTING CONTAINER PRIMARILY FOR A LAMP UNIT

[75] Inventor: Keith Handy, Blackburn, United Kingdom

[73] Assignee: Glasdon Group Limited, England

[21] Appl. No.: 234,348

[22] Filed: Aug. 18, 1988

[30] Foreign Application Priority Data

Aug. 18, 1987 [GB] United Kingdom ..... 8719505

[51] Int. Cl.[4] ..... G09F 7/02

[52] U.S. Cl. ..... 248/222.1; 248/219.2; 248/221.3; 439/304

[58] Field of Search ..... 439/133, 204, 352; 248/219.2, 221.3, 222.1; 362/382, 431, 432

[56] References Cited

U.S. PATENT DOCUMENTS 3,382,558 5/1968 Lutz et al. ..... 439/352 X
4,054,352 10/1977 Rudin ..... 439/304
4,615,575 10/1986 Kossor ..... 439/304

FOREIGN PATENT DOCUMENTS 0185060 8/1922 United Kingdom ..... 439/304
2147986 5/1987 United Kingdom .

*Primary Examiner*—Neil Abrams
*Assistant Examiner*—Khiem Nguyen
*Attorney, Agent, or Firm*—Pravel, Gambrell, Hewitt, Kimball & Krieger

[57] ABSTRACT

An adaptor in combination with a supporting container, the adaptor comprising support means for a lamp unit or other warning mechanism and the supporting container having an open end into which a portion of the adaptor normally located beneath the support means can be inserted. A locking device comprising engageable elements is provided on the aforesaid portion of the adaptor and the interior of the supporting container such that the elements engage one with another some distance within the container from the open end when the unit is inserted so as to prevent removal of the unit. The locking device is arranged to be unlocked by a key insertable into the tubular container to cause disengagement of the engaged elements one from another so that the unit can be removed.

10 Claims, 2 Drawing Sheets

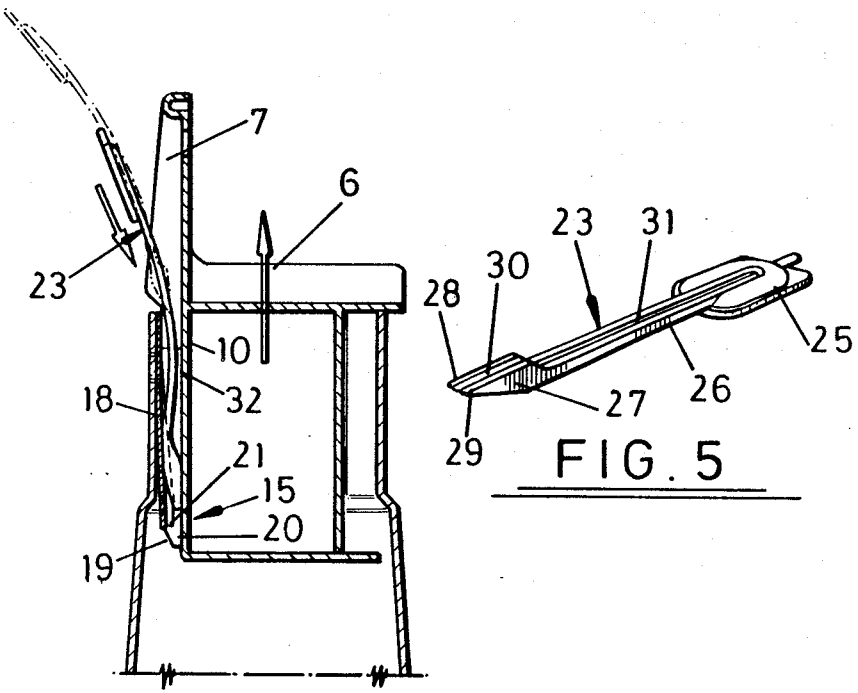
FIG. 5
FIG. 4
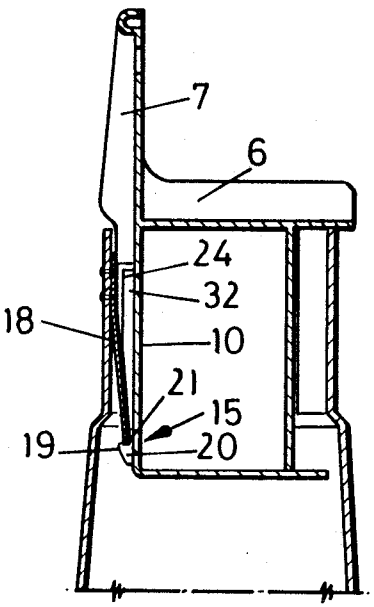
FIG. 3

ADAPTOR AND SUPPORTING CONTAINER PRIMARILY FOR A LAMP UNIT

BACKGROUND OF THE INVENTION

1. Field of the Invention

The present invention relates to an adaptor and supporting container primarily for a battery powered lamp unit. In particular, the invention relates to an adaptor and supporting container for a lamp unit to form part of a road hazard warning system.

2. Description of the Prior Art

Our United Kingdom Patent Specification No. 2147986 discloses a battery powered lamp unit in combination with a supporting container. The lamp unit of this combination is specially adapted to comprise a self-contained unit with its own batteries and to lock into the supporting container so that it can only be removed therefrom by means of a key. Other self-contained lamp units for forming part of a road hazard warning system are known. However, hitherto these lamp units could not be attached to supporting containers as described in the aforesaid patent specification as they lacked the necessary locking means.

SUMMARY OF THE INVENTION

The object of the present invention is to overcome the aforementioned disadvantage and permit any self-contained lamp unit or other warning mechanism, such as a reflector unit, to be releasably mounted on a supporting container.

According to the present invention, there is provided an adaptor in combination with a supporting container, the adaptor comprising support means for a lamp unit or other warning mechanism and the supporting container having an open end into which a portion of the adaptor normally located beneath the support means can be inserted, locking means comprising engageable elements being provided on the aforesaid portion of the adaptor and the interior of the supporting container such that said elements engage one with another some distance within the container from said open end when the unit is inserted so as to prevent removal of the unit, and said locking means being arranged to be unlocked by key means insertable into the tubular container to cause disengagement of aforesaid engaged elements one from another so that the unit can be removed.

Preferably, the locking means automatically locks when the integral unit is inserted a sufficient distance into the container.

Preferably, the support means comprise a platform on which the lamp unit or other mechanism is mounted.

Preferably, the adaptor comprises a lug through which a fastening means is passed to secure the adaptor to the lamp unit or warning mechanism.

Preferably, the key means is insertable into the container through an aperture in the container wall. Alternatively, to unlock said locking means the key means may be insertable through the said end of the container in which the unit is inserted.

Preferably, the engageable elements provided on the interior of the supporting container are located at the bottom of a recess formed in the interior surface of the open end of the supporting container, which recess defines, with the adjacent surface of the adaptor when locked into the container, a pocket into which the key means may be inserted to unlock the locking means at the bottom thereof.

Preferably also, said adjacent surface of the adaptor is provided with a channel to assist in the correct location of the key means into the pocket to unlock the locking means.

The locking means may comprise a resiliently biased leaf spring engageable with and disengageable from abutment means. The spring may be mounted on the inside of the container wall and the abutment means on the exterior of the adaptor, or the leaf spring may be on the adaptor and the abutment means on the interior of the container.

The spring may be disposed at an angle transverse to the longitudinal axis of the container and adaptor so that as the adaptor is located within the container by a relative movement between the two, the abutment means and spring can, one relatively to the other, pass with a displacement of the spring by the abutments towards a more axial disposition until the abutment means leaves a free edge of the spring which then returns back to or towards its former attitude so that edge can engage the abutment means and prevent its passing the spring if effort is made to pull the adaptor from the container.

The key means acts on the spring to move it from its abutment means obstructing position so that the adaptor can be removed.

The key means may be of flexible material, for example plastics, so it may be deformed after insertion through the aperture so as to move along a direction generally axially of the container towards the locking means by force exerted on that part of the key means externally of the container. The leading end of the key means may have a wedge shape, for ease of cooperation with the spring when releasing it from the abutment.

If an unauthorised tool such as a piece of wire is inserted into the opening as it lacks a wedge shaped head of the correct dimensions to act on the spring. This means that it is not possible to disengage the spring from the abutment means making it virtually impossible for any one but a dedicated thief with time to spare to remove the adaptor from the container if that person lacks the proper key.

For additional security the locking means may comprise a plurality of locking arrangements acting to engage within the tubular container and lock the unit thereto.

The container is preferably tubular and can be any desired tube It may for example be a tubular plastics upright to support horizontal rails of a road traffic or road works barrier, in which case the lamp unit or warning mechanism projects from the top of the post.

BRIEF DESCRIPTION OF THE DRAWINGS

The invention will now be further described, by way of example, with reference to the accompanying drawings, in which:

FIG. 3 is a longitudinal sectional view of an adaptor and supporting container according to the present invention and as shown in FIGS. 1 and 2;

FIG. 4 is a view similar to that shown in FIG. 3 but illustrating the use of key means to unlock the adaptor from the supporting container; and FIG. 5 is a perspective view of the key means shown in FIG. 4.

DESCRIPTION OF THE PREFERRED EMBODIMENT

Figures 1, 2, 2A, 2B:
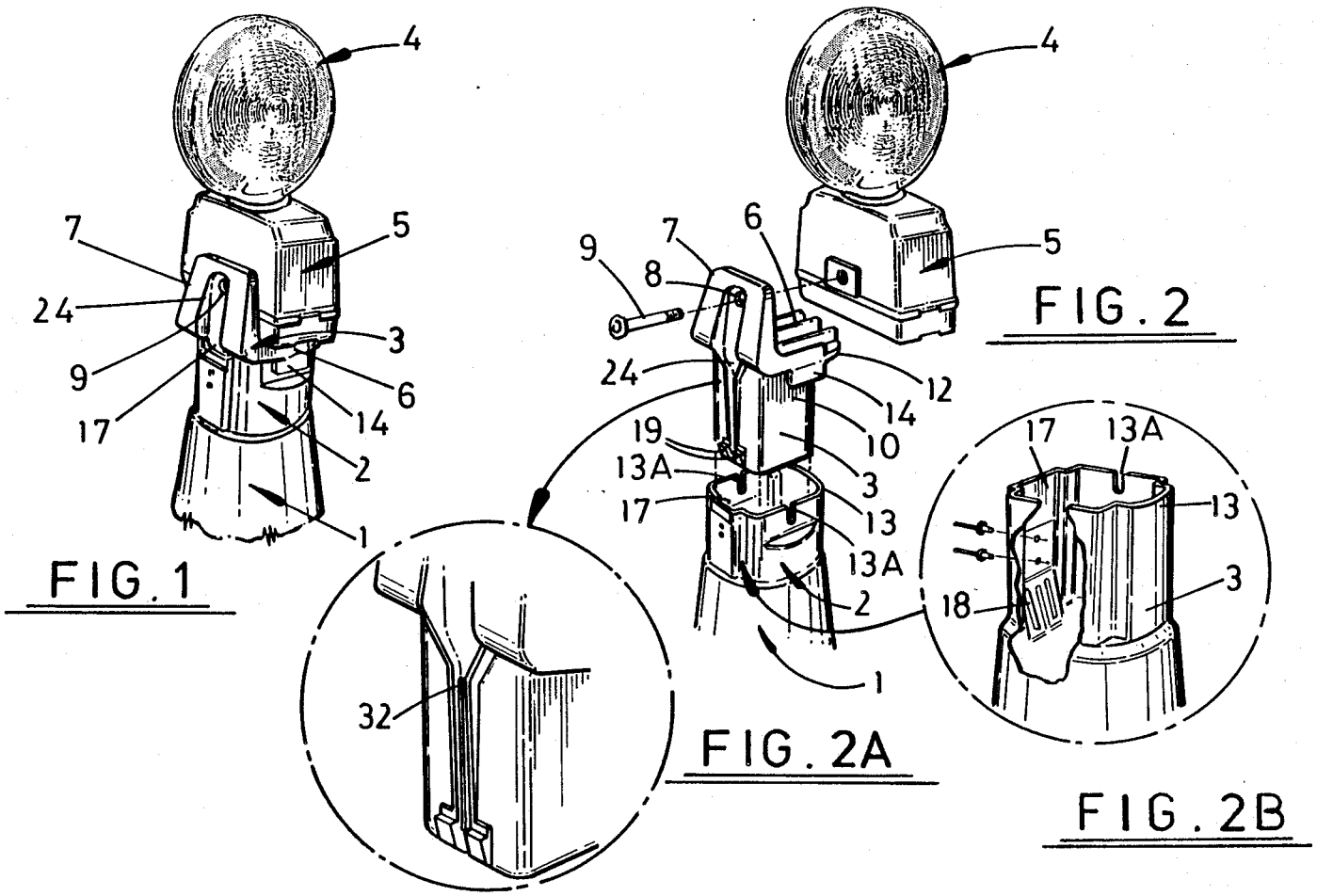
FIG. 1 is a perspective view of the upper part of a post formed according to the invention and intended to form part of a road hazard warning system.
FIG. 2 is an exploded view of the post shown in FIG. 1 showing the components thereof.
FIGS. 2A and 2B are enlarged views of portions of the post shown in the exploded view of FIG. 2.

Referring to FIGS. 1 and 2, the post comprises a tubular supporting container 1, typically of conical shape and standing on a base (not shown).

The base may be in the form of a container closable by a removable plug or cover so that liquid ballast or particulate or friable solid ballast can be introduced into the container. Additionally, the base may have a recessed tray-like upper part to receive solid ballast material.

At its upper end, the post 1 has a substantially cylindrical part 2 to which is attached an adaptor 3 mounting a lamp unit 4 with an integral battery compartment 5.

The adaptor 3 may be a substantially one piece moulding of plastics material with additional parts bonded thereto by adhesive As shown in FIG. 2, the adaptor 3 comprises a ribbed platform 6, on which the lamp unit 4 can be mounted, and an upwardly projecting lug 7. The lug 7 forms a rest against which battery compartment 5 of the lamp unit 4 is supported and is provided with a hole 8 through which a bolt 9 can be passed to secure the unit 5 to the adaptor. Preferably, the bolt 9 is of the security bolt type with a tamper-proof head.

The lower portion 10 of the adaptor 3 beneath the platform is of hollow tubular section. As shown in FIG. 2, it may be of a substantially square or rectangular section or alternatively it may be of circular or elliptical section. However, its section should be similar to that of the upper part 2 of the post 1 so that this lower portion 10 of the adaptor 3 can be located within the upper part 2 and form a snug fit therewith. In order to prevent the adaptor 3 being pushed too far down into the upper part 2 of the post 1, the rim 12 of the platform 6 overhangs the lower portion 10 and abuts the upper rim 13 of the post 1. Two depending lugs 14, on opposing sides of the platform 6 are also provided to locate over the rim 13 on the exterior of the post 1.

The adaptor 3 locks to the supporting container 1 by means of a locking arrangement 15 comprising engageable elements provided on the lower portion 10 of the adaptor 3 and on the interior of the container 1. Secured to the interior of a recess 17 formed in the interior wall surface of the container 1 is a bifurcate metal strip 18. The strip 18 is bent and secured to the container at one end only so that it forms a leaf spring with two fingers depending downwardly into the container 1 and is resiliently biased towards the interior of the container 1. Engageable with each of the fingers of the spring 18 is an abutment means in the form of a pair of outwardly projecting clips 19 located side by side on the lower edge of the portion 10 of the adaptor 3. The clips 19 are formed in the shape of an arrow head so that they each have a flat surface 20 extending outwardly from the adaptor 3 at an acute angle which terminates with a second flat surface 21 projecting substantially normally from the adjacent surface of the adaptor 3. As shown in FIG. 3, when the adaptor 3 is pushed downwardly into the container 1, the surfaces 20 of the clips 19 bear against the fingers of the spring 18 respectively and displace them to allow location of the adaptor 3 in the container 1. However, once the surfaces 20 are pushed past the lower edge 22 of the spring 18, the latter springs resiliently back to its former position. In this position, the lower edge 22 of each of the fingers of the spring 18 is located above the respective surface 21 of the clips 19, which thereby prevent the adaptor 3 from being withdrawn from the container 1.

To prevent forcible rotation of the adaptor 3 within the post 1, which can have the effect of disengaging the locking arrangement 15, the upper rim 13 of the post 1 is provided with two diametrically opposed slots 13A. When the adaptor 3 is engaged within the post 1, depending ribs (not shown) linking the lugs 14 to the underside of the platform 6 are designed to engage within the slots 13A and thereby prevent rotation of the adaptor 3 within the post 1. The lugs 14 cover the slots 13A hiding this engagement in the assembled unit.

It can be seen from the drawing, that once the adaptor 3 is located in position in the container 1 that the recess 17 defines, with the adjacent surface of the adaptor 1, a pocket at the base of which is located the locking arrangement 15. In order to disengage the adaptor 3 from the container 1 a key 23, as shown in FIG. 5, must be used. The pocket, therefore, protects the locking arrangement 15 but allows access thereto for the key 23, as shown in FIG. 4. Additionally, a channel 24 is formed in the exterior surface of the adaptor 3 adjacent the recess 17. The channel 24 runs between the clips 19 and is designed to assist in the correct location of the key 23 in the pocket.

The key 23 comprises a flexible plastics strip formed with a handle 25 at one end of a slender shank 26 and a wedge-shaped head 27 at the other end. The head 27 is bifurcated into two fingers 28 and 29 and a slot 30 is extended from between the fingers 28 and 29 to form a groove 31 along the head 27 and the shank 26 of the key. The width of the head 27 is designed so that it can slide within the channel 24. However, the depth of the head 27 is designed to be greater than the combined depth of the surfaces 21 of the clips 19 and the depth of the channel 24.

To disengage the adaptor 3 from the container 1, therefore, the head of the key 23 is inserted into the channel 24 and pushed downwardly into the pocket. A rib 32 is formed along the length of the channel 24 in the exterior surface of the adaptor 3 and the groove 31 of the key 23 is intended to locate over this rib 32 to assist in the correct positioning of the key 23. As the key 23 is pushed downwardly, the wedge-shaped head 27, being of greater dimensions than the clips 19, as described above, acts on the spring 18. The bifurcate fingers 28 and 29 each act on one of the fingers of the spring 18 so that the lower edge 22 of the fingers of the spring 18 ar biased away from the adaptor 3 and eventually clear the edge of the surfaces 21. When this occurs, the adaptor 3 can then be lifted out of the container 1 along with the key 23.

As previously described, in an alternative arrangement, the locking arrangement 15 could be arranged to be accessed by the key 23 through a hole or aperture formed in the cylindrical part 2 of the container 1.

Thus, the adaptor 3 permits any standard lamp unit or other road hazard warning system to be releasably engaged to a supporting container as described. The requirement for a specially adapted unit is therefore obviated.

I claim:

1. An adaptor in combination with a supporting container, the adaptor comprising support means for a lamp unit or other warning mechanism and the supporting container having an open end into which a portion of the adaptor normally located beneath the support means can be inserted, locking means comprising engageable elements being provided on the aforesaid portion of the adaptor and the interior of the supporting container such that said elements engage one with another some distance within the container from said open end when the unit is inserted so as to prevent removal of the unit, a lug through which a fastening means is passed to secure the adaptor to the lamp unit or warning mechanism, and said locking means being arranged to be unlocked by key means insertable into the tubular container to cause disengagement of aforesaid engage elements one from another so that the unit can be removed.

2. An adaptor according to claim 1, wherein the locking means automatically locks when the integral unit is inserted a sufficient distance into the container.

3. An adaptor according to claim 1, wherein the support means comprise a platform on which the lamp unit or other mechanism is mounted.

4. An adaptor according to claim 1 wherein the key means is insertable into the container through an aperture in the container wall.

5. An adaptor according to claim 1, wherein the key means may be insertable through the said end of the container in which the unit is inserted to unlock said locking means.

6. An adaptor according to claim 1, wherein the engageable elements provided on the interior of the supporting container are located at the bottom of a recess formed in the interior surface of the open end of the supporting container, which recess defines, with the adjacent surface of the adaptor when locked into the container, a pocket into which the key means may be inserted to unlock the locking means at the bottom thereof.

7. An adaptor according to claim 6, wherein said adjacent surface of the adaptor is provided with a channel to assist in the correct location of the key means into the pocket to unlock the locking means.

8. An adaptor according to claim 1, wherein the locking means comprises a resiliently biased leaf spring engageable with and ,disengageable from abutment means.

9. An adaptor according to claim 8 wherein the spring is disposed at an angle transverse to the longitudinal axis of the container and adaptor so that as the adaptor is located within the container by a relative movement between the two, the abutment means and spring can, one relatively to the other, pass with a displacement of the spring by the abutments towards a more axial disposition until the abutment means leaves a free edge of the spring which then returns back to or towards its former attitude so that edge can engage the abutment means and prevent its passing the spring if effort is made to pull the adaptor from the container.

10. An adaptor according to claim 1, wherein the fastening means comprises a threaded bolt insertable through an aperture in the lug and threaded into the lamp unit or warning mechanism, the lamp unit and platform engaging to obstruct rotation of the lamp unit relative to the adaptor about the threaded bolt.

* * * * *